United States Patent [19]

Woolaver et al.

[11] 4,449,469

[45] May 22, 1984

[54] MECHANICAL CLUTCH/DECOUPLER FOR HYDRAULIC PUMPS

[75] Inventors: Dennis A. Woolaver, Rockville, Md.; A. Erich Baitis, Stafford, Va.

[73] Assignee: The United States of America as represented by the Secretary of the Navy, Washington, D.C.

[21] Appl. No.: 247,486

[22] Filed: Mar. 25, 1981

[51] Int. Cl.[3] ..... B63H 25/22

[52] U.S. Cl. ..... 114/150

[58] Field of Search ..... 114/144 R, 144 E, 150, 114/122, 126; 318/588, 589

[56] References Cited

U.S. PATENT DOCUMENTS 3,349,744 10/1967 Mercier et al. ..... 114/150

*Primary Examiner*—Trygve M. Blix
*Assistant Examiner*—Jesûs D. Sotelo
*Attorney, Agent, or Firm*—R. F. Beers; L. A. Marsh; R. F. Gnuse

[57] ABSTRACT

A ship steering system includes a pump assembly for controlling hydraulically actuated rudders, a first actuation unit for translating a helm steering command signal into a mechanical control signal for the pump assembly, and a second actuation unit for translating a combined helm steering command signal and ship roll reduction command signal into a mechanical control signal for the pump assembly. A decoupling device is interconnected to the first and second actuation units and the pump assembly for decoupling the first actuation unit from the pump assembly when the second actuation unit is activated.

7 Claims, 7 Drawing Figures

MECHANICAL CLUTCH/DECOUPLER FOR HYDRAULIC PUMPS

BACKGROUND OF THE INVENTION

This invention generally relates to motion stabilization systems and more particularly to roll reduction devices used aboard marine vessels.

As a result of the increased importance of helicopers and vertical takeoff-landing aircraft as an integral part of naval combat systems, a major thrust of recent research and development effort in surface ship dynamics has been directed toward improving ship/aircraft interfacing. Since the ship/aircraft interface is strongly dependent on weather, ship motions, and wave impact forces, it is desirable to reduce ship roll motions to minimize the possibility of damage to aircraft during landing and takeoff operations. Accordingly, a particular area of ship stabilization research has involved attempts to utilize the rudder systems of ships to control and reduce the rate and magnitude of ship roll motions. However, problems have been experienced in developing compatible roll reduction systems and devices because of operational interference between use of the rudder in reducing roll motions and utilization of the rudder as a steering mechanism.

SUMMARY OF THE INVENTION

The anti-roll device of the present invention overcomes drawbacks with the prior art by providing a roll reduction system which essentially comprises a hydraulic control means connected to the rudder; a pump means coupled to the hydraulic control means; flow control means connected to the pump means for controlling the flow rate of fluid through the pump means; and a first actuation means connected to the flow control means for translating helm signals into impulses for the flow control means. The roll stabilization device also includes a second actuation means for translating a combined helm and anti-roll signal into impulses for the flow control means. When the second actuation means is coupled to the flow control means and activated, the first actuation means is decoupled from the flow control means. This is accomplished with a mechanical clutch-/decoupler which is operatively connected to the first and second actuation means.

The mechanical decoupler includes a bearing element provided with tapered end portions designed to selectively engage conforming recesses in coupling elements of the first and second actuation means. When disposed in the engaged position, the bearing element and a coupling element rotate as an integral unit as torque forces are transmitted therebetween. A channel is formed in the recesses of each coupling element to receive a conforming flange on the distal end portions of the bearing element. The interlocking arrangement formed by insertion of a flange into a channel-shaped recess in the coupling element tends to preclude axial separation and "wobble" motions between the bearing and coupling elements as the coupling element is rotated by a mechanical linkage.

The bearing element and the spaced coupling elements are arranged to rotate about a common coaxial shaft with the bearing element positioned between the coupling elements. A pivot or shift arm, which is driven by a hydraulic mechanism in the second actuation means, is connected to the bearing element for shifting the bearing element axially along the shaft until the mating surfaces of the bearing and respective coupling element are disposed in a contiguous abutting relationship. As the bearing element is biased against the coupling element, the mating surfaces cause the bearing element to rotate until the abutting relationship is achieved. A steering control impulse from one of the actuation means is transmitted through the appropriate coupling element to the bearing element, which is directly coupled to the flow control means for the pump means.

Accordingly, an object of the present invention is to stabilize marine vessels against wave and wind induced roll motions.

Another object of this invention is to provide a roll stabilization system for marine vessels which is coupled to the rudder of the ship without affecting the steering of the vessel.

A further object of the present invention is to provide a means for selectively coupling a roll reduction system to the steering control of the ship.

BRIEF DESCRIPTION OF THE DRAWINGS

The novel features which are believed to be characteristic of this invention are set forth with particularity in the appended claims. The invention itself however, both as to its organization and method of operation, together with further objects and advantages thereof, may be best understood by reference to the following description taken in connection with the accompanying drawings, in which:

DETAILED DESCRIPTION OF THE INVENTION

Figure 1:
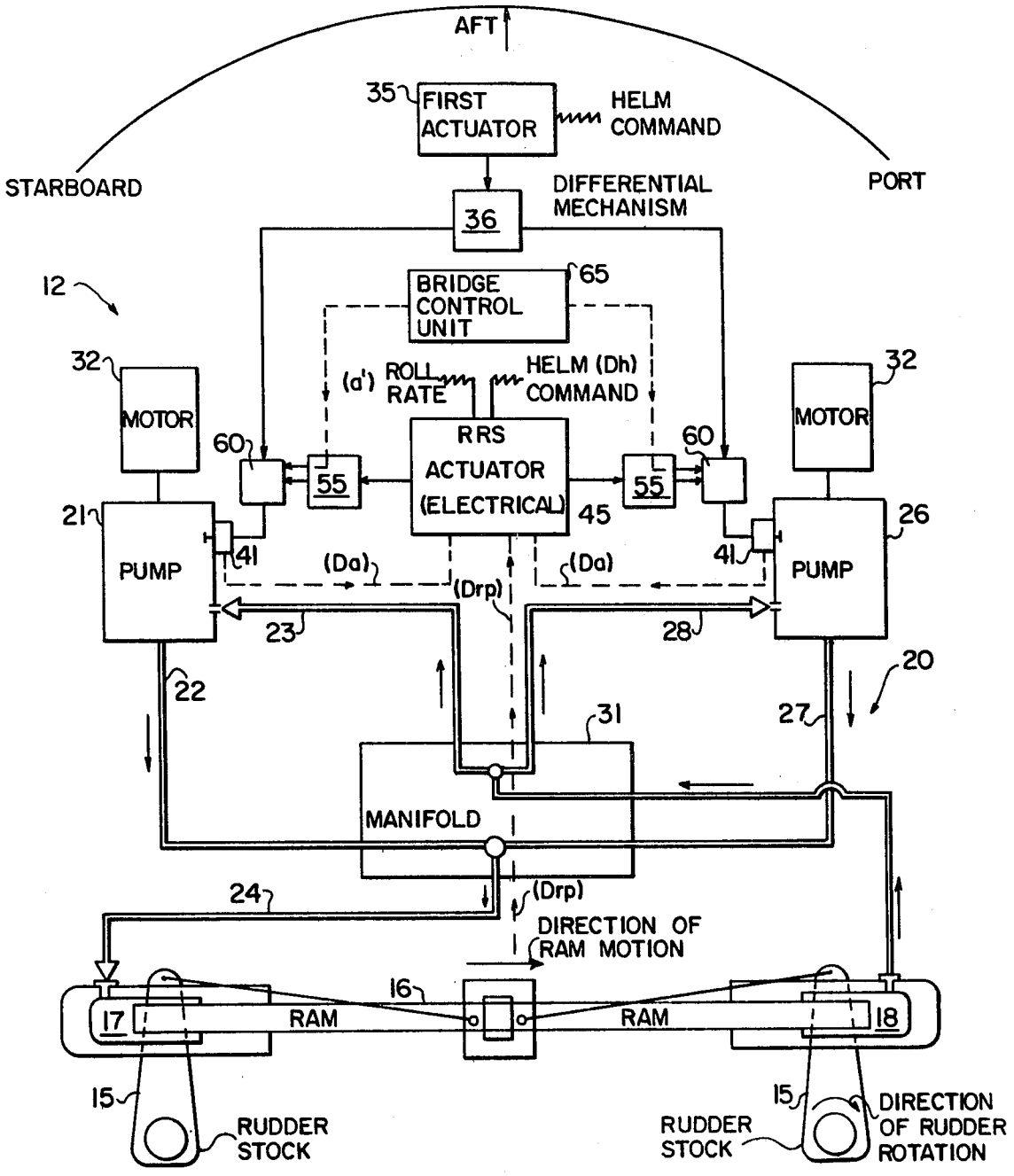
FIG. 1 is a simplified diagramatic view of the roll reduction system of the present invention.

Referring now to the drawings and to FIG. 1 in particular, there is shown a simplified diagram of the roll reduction rudder control system 12 of the present invention. The roll reduction system 12 includes a hydraulically actuated control means in the form of a hydraulic fluid circuit 20 which is coupled to a hydraulic ram mechanism 16 that drives a tandem arrangement of rudders 15. A pump means comprising hydraulic pumps 21, 26 and pump motors 32 is interconnected with the hydraulic circuit 20 to produce a preselected fluid flow in the hydraulic circuit 20 that causes ram mechanism 16 to move rudders 15 to a predetermined position. The roll reduction system 12 also includes a hydromechanical flow control means in the form of flow controls 41 that are coupled to pumps 21, 26 for controlling the flow rate of hydraulic fluid through pumps 21, 26; a first actuation means which is connected to flow controls 41 for translating helm signals into impulses for the flow controls 41; and a second actuation means for translating a combined helm and anti-roll signals into impulses for flow controls 41. The second actuation means is coupled to the flow controls 41 so that the first actuation means is decoupled from pumps 21, 26 when the second actuation means is activated.

The ram mechanism 16 is pivotally connected to the arrangement of tandem rudders 15 so that a shift of the ram mechanism 16 in one direction causes a corresponding rotation of the rudders 15 in the same direction. More particularly, the end portions of the elongated ram mechanism 16 are contained within hydraulic chambers 17, 18 so that a flow of pressurized fluid into chamber 17 causes a corresponding shift of the ram end portion out of the chamber 17. The hydraulic fluid circuit 20 includes two fluid conduits extending from each pump, wherein a flow line from one pump is connected to one of the hydraulic chambers 17 and the other flow line from such pump is connected to the other hydraulic chamber 18. Thus, in FIG. 1 ducts 22 and 23 from pump 21 are connected to respective chambers 17 and 18, and ducts 27 and 28 from pump 26 are connected to respective chambers 17 and 18. To provide a uniform response to impulses from the dual pumps, flow lines 22, 27 are merged together into a single conduit 24 at manifold section 31, and flow lines 23, 28 are merged together to form a single conduit 29 at manifold section 31.

Pumps 21 and 26 operate in response to the signals from flow controls 41 to cause the hydraulic fluid to flow through the pumps in a predetermined direction to the appropriate ducts and conduits at a predetermined pressure and flow rate. As shown for example in FIG. 1, the signal from flow controls 41, which is often referred to as the swash plate flow controls, has actuated pumps 21, 26 to produce a flow of fluid out of right chamber 18 and into left chamber 17, as indicated by the arrows, to cause a clockwise rotation of ridders 15. If the signals to the swash plate flow controls 41 change so that it is desired to rotate rudders 15 in a counterclockwise direction, a mechanical impulse is fed to pumps 21, 26 to produce a flow of fluid into right chamber 18 and out of the left chamber 17. As rudders 15 approach the predetermined position, the flow of fluid through pumps 21, 26 is continuously reduced until the flow rate reaches zero at the desired rudder position. A compatible pump 21, 26 provided with an integral swash plate flow control 41 is manufactured by New York Air Brake (e.g part #890172, model 45L0172 or Dyna Power Models 30, 45, 60, 120, 210). A suitable electric pump motor 32 is manufactured by Reliance Electric Co. (Mil Spec. Mil-M-17060, Navy Service A Frame #286 UN).

Figure 4:
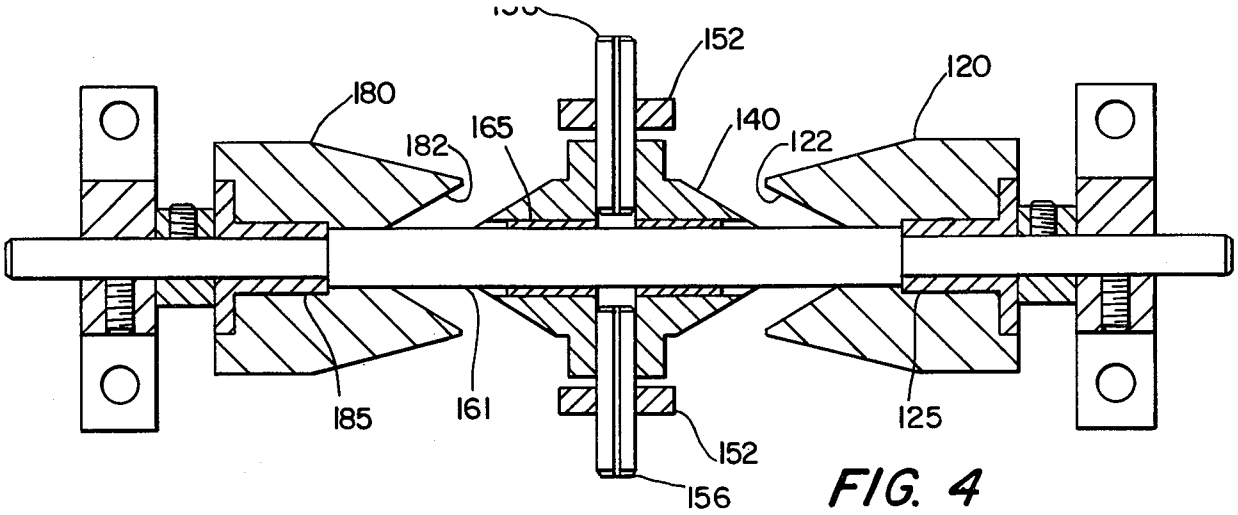
FIG. 4 is a sectional view of coupling members of the mechanical decoupler.
Figure 7:
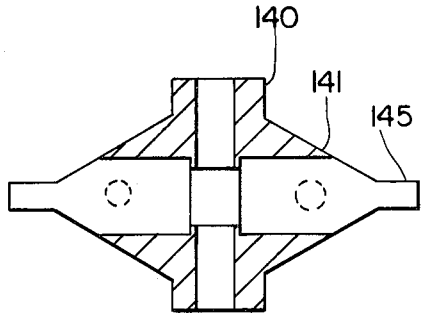
FIG. 7 is a sectional view of the bearing element.
Figure 6:
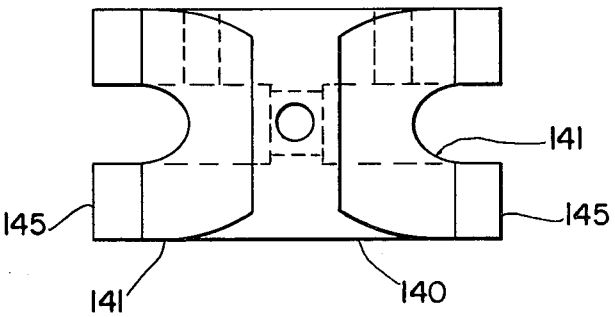
FIG. 6 is a top view of the bearing element.
Figure 5:
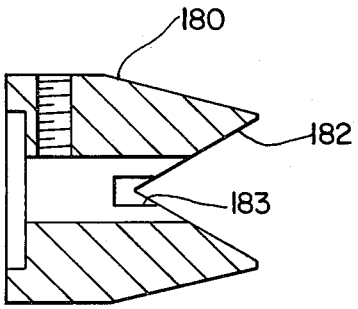
FIG. 5 is a sectional view of the coupling element.

The first actuation means includes an electromechanical actuation device 35, such as manufactured by Sperry Marine Division of Sperry Rand (Rotary Hydraulic Power Unit #1880060 or 1883174), that translates electrical helm signals into appropriate signals for a differential mechanism 36. The differential mechanisms 36, such as manufactured Jered Industries (Control Unit #2004-D), are connected to left and right swash plate flow controls 41 and translate the impulses from the first actuator 35 into a mechanical movement of the swash plate flow control 41 to a predetermined position. The relative position of the swash plate flow controls 41 with respect to a neutral position, causes pumps 21, 26 to operate and produce a specific flow rate in the hydraulic lines. As shown in FIG. 4, the differential mechanism 36 is coupled with coupling element 180 by a linkage 37. If the bearing member 140 is operatively engaged with coupling element 180, a rotation of coupling element 180 by linkage 37 causes a likewise rotation of bearing member 140, bar 154, linkage 155, and swash plate flow controls 41.

The second actuation means includes an electrical roll reduction system actuator 45, therein referred to as a second actuator, that translates electrical signals from a roll rate sensor 46 and the helm into appropriate signals for a mechanical actuator 55 that is linked thereto. The particular electrical circuit details of the second actuator 45 are set forth in a copending application entitled "ELECTRICAL ACTUATOR FOR SHIP ROLL STABILIZATION" by Dennis A. Woolaver, Ary E. Baitis, and Richard T. Nigon, Ser. No. 248,389, filed Mar. 31, 1981, the teachings thereof are herein incorporated by reference. The mechanical actuators 55 for the second actuation means are coupled to mechanical clutch/decouplers 60, and the mechanical actuators 55 translate signals from second actuator 45 into mechanical impulses for the swash plate flow controls 41. A more specific operation of the mechanical actuators 55 is set forth in a copending application entitled "MECHANICAL ACTUATION DEVICE FOR SHIP ROLL STABILIZATION" by Dennis A. Woolaver and Ary E. Baitis, Ser. No. 247,485, filed Mar. 25, 1981, the teachings thereof are herein incorporated by reference. Mechanical clutch/decoupler devices 60 interconnected the first and second actuators 35, 45 and the swash plate flow controls 41 so that the clutch device 60 disengages the first actuator 35 and differential mechanism 36 from the swash plate flow controls 41 when the second actuations means is activated. Further operative details of the roll reduction unit 12 are set forth in a copending application entitled "SHIP ROLL STABILIZATION SYSTEM" by Dennis A. Woolaver and Ary E. Baitis, Ser. No. 247,484, filed Mar. 25, 1981, the teachings of which are herein incorporated by reference.

Figure 2:
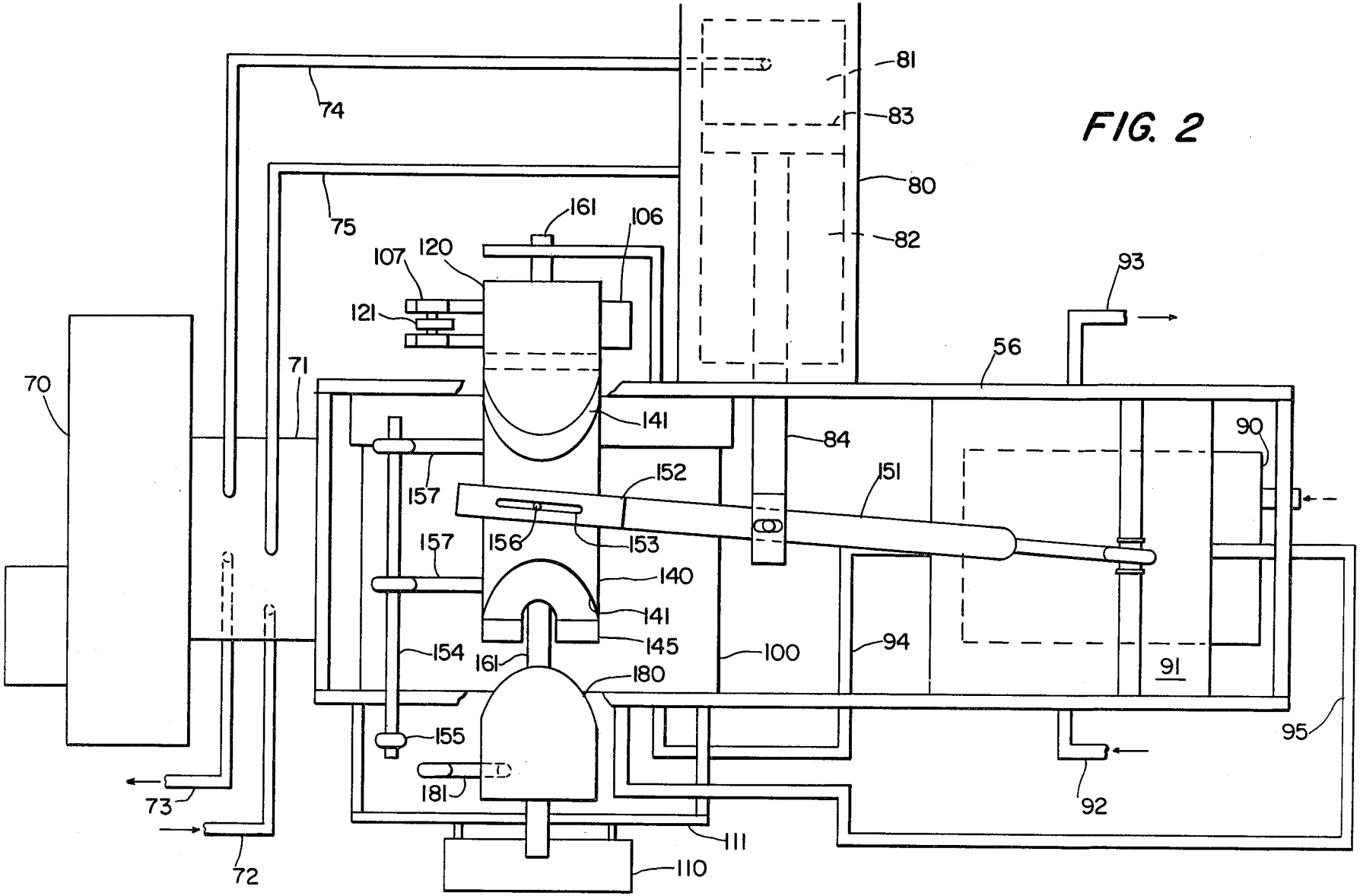
FIG. 2 is a bottom view of a mechanical actuator depicting the mechanical decoupler of the present invention.
Figure 3:
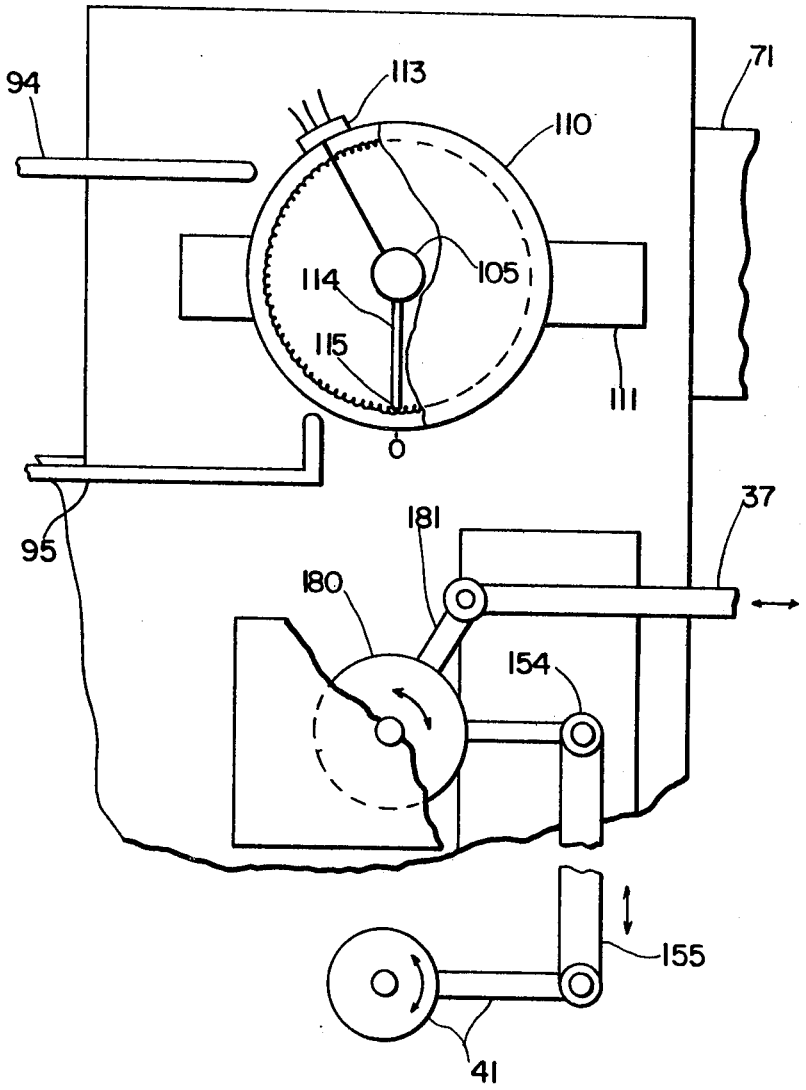
FIG. 3 is a side view of mechanical actuator showing linkage elements of the mechanical decoupler.

Referring now to FIG. 2 there is shown a bottom view of the mechanical actuator 55 and mechanical decoupler 60 of the present invention. Means for moving shift arm 151 of mechanical decoupler 60 include a solenoid operated hydraulic valve 70 for activating a control piston 83 which is coupled to shift arm 151. The servo-valve 70 is of the general type disclosed in U.S. Pat. Nos. 3,023,782; 3,171,439; and 3,736,958. The servo-valve 70 functions as an "on-off" switch to control the flow of hydraulic fluid in source line 72 and discharge line 73. In the "non-energized" mode servo-valve causes hydraulic fluid in source line 72 to flow into fluid line 74 and hydraulic fluid in fluid line 75 to flow into discharge line 73. This causes control piston 83 and piston rod 84 to move toward side plate 56 so that shaft arm 151 moves bearing member 140 to engage coupling element 180. In this position the first actuation means of first actuator 35 and differential mechanism 36 are operatively interlinked with the swash plate flow controls 41. In the "energized" mode of operation, servo-valve 70 reverses the flow of hydraulic fluid through manifold plate 71 so that hydraulic fluid in source line 72 now flows through fluid line 75 to hydraulic chamber 82 and fluid in the other hydraulic chamber 81 flows through fluid line 74 to discharge line 73. This causes control piston 83 to withdraw into hydraulic cylinder 80, thereby moving shift arm 151 to decouple the first actuation means from the swash plate flow controls 41 and operatively interconnecting second actuator 45 and mechanical actuator 55 with the swash plate flow controls 41. The servo-valve 70 is energized by switching bridge control unit 65 to the "on" position, which produces the electrical signal for solenoid element of servovalve 70, as indicated in FIG. 1 by the directional broken lines extending from bridge control unit 65 to mechanical actuator 55.

When the second means is activated, electrical signals from second actuator 45 are fed to a solenoid operated fluid control valve 90 of the type disclosed in U.S. Pat. Nos. 3,023,782 and 3,228,423. The fluid control valve 90 produces a predetermined flow of hydraulic fluid from source conduit 92, through manifold unit 91, and into fluid conduits 94, 95 and discharge conduit 93. Conduits 94, 95 are connected to opposing subchambers of a rotary hydraulic actuator 100. Rotationally keyed to one end portion of the rotary vane of the hydraulic actuator is a pivot arm 106 and a linkage bar 107 which is pivotally interconnected with level element 121 secured to coupling element 120. Connected to the other end portion of the shaft for the rotary vane is a potentiometer 110 which provides a feedback signal (Dpa) that represents the position of swash plate flow controls 41. Feedback signal (Drp) represents the position of rudders 15.

As shown in the FIG. 4 sectional view, coupling element 120, 180 and bearing element 140 are arranged to rotate about a support shaft 161 on respective bushing elements 125, 185, 165. The opposite end portions of support shaft 161 are provided with reduced diameter sections so that coupling elements 120, 180 are maintained in a fixed axial position while oscillating about support shaft 161.

The opposite end portions 141 of bearing element 140 are tapered to present a V-shaped abutting end surface to engage conforming recesses 122, 182 in coupling elements 120, 180. The angle defined by the surfaces of end portion 141 or recesses 122, 182 should be from about 40° to about 90°. This arrangement provides a means whereby bearing element 140 can automatically align itself in the proper position with the selected coupling element as the rudder control function is switched from the first actuation means (e.g. actuator 35, differential 36, coupling element 180) to the second actuation means (e.g. electrical actuator 45, mechanical actuator 55, coupling element 120) and vice-versa. For example, the first actuation means is controlled by the helm steering command signal (Dh) while the second actuation means is controlled by both the helm steering command signal and a roll reduction signal (e.g. rudder command $Drc=Dh+Ds$) so that there will normally be a relative rotational displacement between coupling elements 120, 180 any given moment in time. Thus, as the bearing member 140 is shifted from one coupling element to engage the other coupling element, the bearing member will generally not be properly aligned so that the wedge shaped end portion 141 directly engages the conforming recess in the second coupling element. The dual taper of the surface portions defining recesses 122, 182 of the coupling elements 120, 180 and the wedge shaped end portions 141 on bearing element 140 provide a means whereby the bearing element is forced to align itself with the respective coupling element as it is biased against the selected coupling element by shift arm 151. To preclude axial separation between an interengaged coupling element and bearing member as torque forces are applied therebetween, a distal flange 145 is provided on each bearing member end portion 141 to engage a conforming channel shaped recess in the selected coupling element.

Means for permitting rotational displacements of bearing member 140 include a slotted yoke element 152 connected to shift arm 151. A pin element 156 is secured to bearing member 140 and positioned in the yoke slot 153 to serve as a guide means for the oscillating bearing member.

Attached to bearing member 140 are a plurality of spaced levers 157 which are connected to an elongated bar 154, as shown in FIG. 2. A linkage 155 is pivotally connected to one end portion of the elongated bar 154, as shown in FIG. 4. The lower end portion of linkage 155 is connected to the swash plate flow controls 41 for the pumps 21, 26. Thus, a rotational displacement of the bearing member due to a rotational displacement of an interengaged coupling element produces a like rotation of the swash plate flow control 41. Thus, for a swash plate flow control 41 equipped to oscillate ±30° from a neutral position, the coupling elements and bearing member will also be arranged to rotate ±30° from a corresponding neutral position. It is understood that a deflection of the swash plate flow control 41 in one direction from the neutral position produces a flow of hydraulic fluid through the hydraulic circuit 20 in a given direction, and a deflection of the swash plate flow control 41 in the other direction from the neutral position produces a flow of hydraulic fluid in hydraulic circuit in the opposite direction.

Obviously many modifications and variations of this invention are possible in light of the above teachings. For example, the recesses in the coupling elements and the mating projection on the bearing member may have curved surfaces. It is therefore to be understood that within the scope of the appended claims the invention may be practiced otherwise than as specifically described.

What is claimed is:

1. In a ship steering system having pump means controlling hydraulically actuated rudders, a first actuation means for translating a helm command signal into a mechanicl control signal for the pump means, and a second actuation means for translating a combined helm and ship roll reduction command signal into a mechanical control signal for the pump means, the improvement comprising:

coupling means for decoupling the first actuation means from the pump means and for coupling the second actuation means with the pump means upon activation of the second actuation means, said coupling means coupling the first actuation means with the pump means and decoupling the second actuation means from the pump means upon deactivation of the second actuation means.

2. The coupling means according to claim 1 wherein the first and second actuation means each include a coupling element, said coupling means further comprising:

a bearing element operatively connected to the pump means; and means for selectively shifting the bearing element to engage the coupling element of the first actuation means upon deactivation of the second actuation means and to engage the coupling element of the second actuation means upon activation of the second actuation means.

3. The coupling means according to claim 2, wherein the coupling elements of the first and second actuation means are coaxially positioned for independent oscillation about a support shaft, the bearing element is positioned on the support shaft between the coupling elements, and the bearing element is arranged to oscillate about and move axially along the support shaft.

4. The coupling means according to claim 3, wherein the coupling elements are provided with V-shaped recesses and the end portions of the bearing member are provided with V-shaped projections that are configured to conform with the V-shaped recesses of the coupling elements.

5. The coupling means according to claim 4, wherein the apex angle of the V-shaped recesses is between about 40° and about 90°.

6. The coupling means according to claim 5, wherein the distal ends of the V-shaped projections are provided with rectangular flange portions and the apexes of the V-shaped recesses are provided with conforming channel shaped recess regions.

7. The coupling means according to claim 2, wherein the coupling elements are provided with recess portions and the bearing element is provided with conforming projection portions so that the respective coupling element and bearing element oscillate as an integral unit to transmit mechanical control signals from the respective actuation means to the pump means.

* * * * *